United States Patent [19]

Yamamoto et al.

[11] Patent Number: 5,060,021

[45] Date of Patent: Oct. 22, 1991

[54] MONOCOMPONENT DEVELOPING DEVICE

[75] Inventors: Masashi Yamamoto, Takatsuki; Toshimitsu Fujiwara, Kobe, both of Japan

[73] Assignee: Minolta Camera Kabushiki Kaisha, Osaka, Japan

[21] Appl. No.: 634,043

[22] Filed: Dec. 26, 1990

[30] Foreign Application Priority Data

Dec. 26, 1989 [JP] Japan ..... 1-339524
Jul. 10, 1990 [JP] Japan ..... 2-183578

[51] Int. Cl.[5] ..... G03G 15/06

[52] U.S. Cl. ..... 355/245; 118/653; 430/903

[58] Field of Search ..... 355/245, 246, 260, 259, 355/210, 251, 253; 118/653, 651, 661, 656, 657; 430/903, 120

[56] References Cited

U.S. PATENT DOCUMENTS 4,100,884 6/1978 Mochizuki et al. .
4,745,429 5/1988 Mukai et al. ..... 118/656
4,755,847 7/1988 Matsushiro et al. .
4,791,882 12/1988 Enoguchi et al. ..... 118/653
4,883,017 11/1989 Yuji et al. ..... 118/653
4,923,777 5/1990 Imai et al. ..... 355/259 X
4,987,454 1/1991 Natsuhara et al. ..... 355/259
4,990,959 2/1991 Yamamuro et al. ..... 355/245

FOREIGN PATENT DOCUMENTS 60-111268 6/1985 Japan .
62-17773 1/1987 Japan .
62-44773 2/1987 Japan .
62-86381 4/1987 Japan .

*Primary Examiner*—A. T. Grimley
*Assistant Examiner*—Sandra L. Hoffman
*Attorney, Agent, or Firm*—Burns, Doane, Swecker & Mathis

[57] ABSTRACT

A monocomponent developing device for use in the electrophotographic image forming apparatus, which comprises a developing roller rotatably supported so as to confront a rotatably supported photoreceptor, a toner supply means for supplying toner onto the developing roller, a regulating member held in contact with a surface of the developing roller and operable to triboelectrically charge the toner, supplied onto the surface of the photoreceptor, while regulating the amount of the toner, and a coating film formed on at least a portion of a surface of the regulating member which is held in contact with the developing roller. The coating film has the same polarity in triboelectric series as that of the toner and is abradable after repetition of developing with a surface of the regulating member consequently exposed.

12 Claims, 3 Drawing Sheets

MONOCOMPONENT DEVELOPING DEVICE

BACKGROUND OF THE INVENTION

1. Field of the Invention

The present invention generally relates to an electrophotographic image forming apparatus such as, for example, a copying machine, a printer or the like and, more particularly, to a monocomponent developing device for use in the electrophotographic image forming apparatus.

2. Description of the Prior Art

As a technique for developing an electrostatic latent image into a visible powder image in the electrophotographic image forming apparatus such as, for example, a copying machine, a printer or the like, two systems are well known in the art. One of them is a one-component or monocomponent system wherein only toner is employed as a developing material and the other of them is a two-component system wherein a developer mix containing toner and carrier beads are employed as a developing material.

The monocomponent developing system has recently come to be highly reevaluated because it makes use of a developing device which is simple in structure, compact in size and, hence, inexpensive to manufacture. The prior art monocomponent developing device is known which comprises a regulating member supported in contact with a surface of a toner carrier onto which toner is supplied. Not only can the toner supplied onto the surface of the toner carrier be triboelectrically charged by the regulating member, but the regulating member can also serve to regulate the amount of the triboelectrically charged toner attracted to the surface of the toner carrier. The regulated amount of the triboelectrically charged toner on the surface of the toner carrier is subsequently supplied onto an electrostatic latent image carrier such as, for example, a photoreceptor.

It has, however, been found that, with the prior art monocomponent developing device of the above discussed structure, a relatively large amount of toner tends to be attracted to an electrostatic latent image formed on a surface of the photoreceptor, while undesirably scattering externally around an electrostatic latent image on the surface of the photoreceptor at an initial stage of use of the developing device. In the worst case it may happen, abnormal fogging of images reproduced on a copying paper is often observed.

SUMMARY OF THE INVENTION

The present invention has for its primary object to provide an improved monocomponent developing device for use in the electrophotographic image forming apparatus, which is effective to develop an electrostatic latent image into a proper and clear visible powder image which would not result in a foggy image on a copying sheet from the beginning of use of the electrophotographic image forming apparatus.

Another important object of the present invention is to provide an improved monocomponent developing device of the type referred to above, wherein the amount of electrostatic charge built up in the toner can be maintained at a constant value during an operable period running from the beginning of use of the developing device to the time at which the entire amount of toner accommodated therein is consumed.

In order to accomplish the above described and other objects of the present invention, there is provided a monocomponent developing device for use in the electrophotographic image forming apparatus, which comprises a developing roller rotatably supported so as to confront a rotatably supported photoreceptor, a toner supply means for supplying toner onto the developing roller, a regulating member held in contact with a surface of the developing roller and operable to triboelectrically charge the toner, supplied onto the surface of the photoreceptor, while regulating the amount of the toner, and a coating film formed on at least a portion of a surface of the regulating member which is held in contact with the developing roller. The coating film has the same polarity in triboelectric series as that of the toner and is abradable after repetition of developing with a surface of the regulating member consequently exposed.

BRIEF DESCRIPTION OF THE DRAWINGS

These and other objects and features of the present invention will become clear from the following description taken in conjunction with a preferred embodiment thereof with reference to the accompanying drawings, in which.

DETAILED DESCRIPTION OF THE EMBODIMENT

Figure 1:
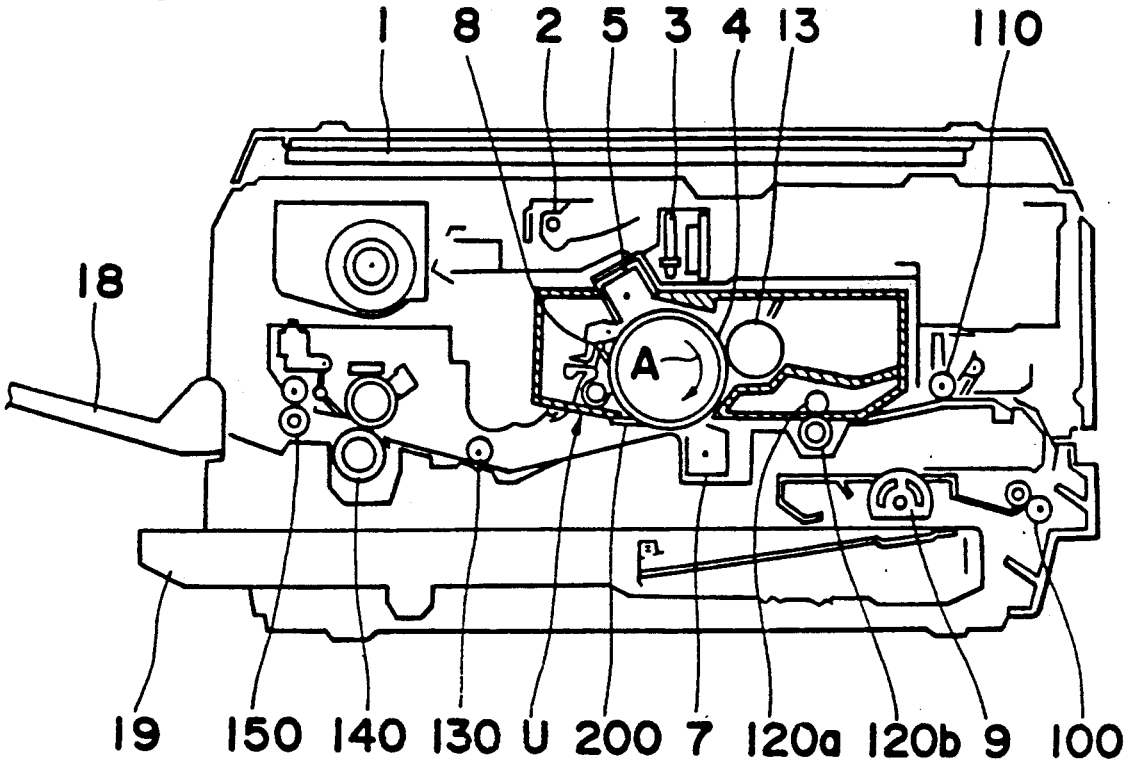
FIG. 1 is a schematic side sectional view of an electrophotographic copying machine embodying the present invention.

The scattering of toner particles externally around an image and/or the abnormal fogging of the image, which tend to occur at the beginning of the monocomponent developing device, appear to result from the following reason.

In general, toner particles are not always of uniform particle size and have a certain distribution of particle size. In the developing device which utilizes the toner particles which are not of uniform particle size, some of the toner particles which are of relatively small particle size tend to be preferentially supplied from the developing device at the beginning of use of the developing device as they are apt to pass through between a surface of the toner carrier and the regulating member held in contact with the surface of the toner carrier. As compared with the toner particles of relatively large particle size, the toner particles of relatively small particle size have small surface areas and are apt to be triboelectrically charged to an amount which is high for a given area of surface. Accordingly, because of the foregoing reason, when the developing device utilizing the toner particles of slightly varying particle size is used in an environment where the relative humidity is relatively low, the amount of charge built up on the toner particles tends to become high at the beginning of use of the developing device. In addition, when the toner is used in an environment where the relative humidity is relatively low, the triboelectric chargeability of the toner particles generally become high enough to cause the amount of charge born by the toner particles to become excessive.

Where the toner particles are excessively charged, the toner particles will be attracted to the toner carrier so strongly as to make the regulating member unable to separate the toner particles from the surface of the toner carrier with no difficulty. Unless the toner particles are properly separated from the surface of the toner carrier, a quantity of toner particles greater than a required or predetermined value will be deposited on the surface of the toner carrier after the latter has passed relative to the regulating member, forming a toner layer of increased thickness on the surface of the toner carrier.

Also, when the electrophotographic image forming apparatus is in operation, the toner carrier has a predetermined potential consequent upon an application of a developing bias voltage thereto. This potential is necessitated to create a potential difference with the potential of the photoreceptor, disposed in face-to-face relationship with the regulating member, by which toner particles can be electrostatically attracted onto the surface of the photoreceptor. Where the toner particles are deposited on the surface of the toner carrier in a quantity greater than the required or predetermined value, however, some of the toner particles which form an outer surface region of the toner layer deposited on the surface of the toner carrier and which are therefore distant from the surface of the toner carrier are susceptible to movement towards the photoreceptor regardless of the potential difference between the toner carrier and the photoreceptor because they are not affected by the potential at the surface of the toner carrier. When an electrostatic latent image is developed by the use of the developing device wherein the toner carried by the toner carrier is so conditioned as hereinabove discussed, a relatively large amount of toner particles will be attracted to the electrostatic latent iamge, resulting in a scattering thereof externally around the developed electrostatic latent image and/or an abnormal fogging of the developed electrostatic latent image.

In order to suppress an increase of the amount of charge on the toner which tends to occur at the beginning of use of the monocomponent developing device, we have made an attempt to construct the regulating member with material having a low chargeability relative to the toner used. For example, where the toner is of a type adapted to be charged to a negative polarity, the use of fluorine containing resin such as, for example, polytetrafluoroethylene, polyfluorinated vinylidene, PFA, FEP, ETFE or CTFE as material for the regulating member.

However, when the regulating member is made of the material having a low chargeability relative to the toner used, the tendency of the toner to be the excessively charged at the initial stage of use of the developing device could be successfully suppressed with the consequent elimination of the problems associated respectively with the scattering of toner particles and the image fogging. However, it has been found that the continued use of the developing device resulted in an insufficient charging of the toner to such an extent as to bring about a foggy image and also a fall of some of toner particles from the surface of the toner carrier, with no satisfactory image being obtained consequently.

This insufficient charging of the toner has occurred as a result of the toner particles of relatively large size having been used for the development of the electrostatic latent image into a visible powder image. As hereinbefore discussed, at the initial stage of use of the monocomponent developing device, the toner particles which are of relatively small particle size are preferentially supplied from the developing device. However, with the passage of time during which the developing device is used, the toner particles of relatively large particle size subsequently supersede the toner particles of relatively small particle size as the latter are consumed. As compared with the toner particles of relatively small particle size, the toner particles of relatively large particle size have large surface areas and are apt to be triboelectrically charged to an amount which is low for a given area of surface. Accordingly, where the regulating member is made of the material having a low chargeability relative to the toner used, the toner particles of relatively large particle size are not triboelectrically charged sufficiently and, consequently, some of the toner particles of relatively large particle size which have failed to be triboelectrically charged tend to deposit on a copying sheet, thereby constituting a cause of the foggy image reproduction on the copying sheet.

In order to substantially eliminate the above discussed problems, we have developed the present invention which is characterized in that an abradable coating film made of material having the same polarity in triboelectric series as that of the toner used is formed on at least a portion of the regulating member which is brought into contact with the toner carrier.

Thus, according to the present invention, even though at the initial stage of use of the monocomponent developing device the toner particles of relatively small particle size are introduced into between the regulating member and the toner carrier, the presence of the coating film, which is made of the material having the same polarity in triboelectric series as that of the toner used, in that portion of the regulating member which is brought into contact with the toner carrier is effective to eliminate the problem in that the triboelectric chargeability of the toner particles of small particle size tends to be lowered and the amount of charge built up in the toner tends to become excessive.

Since the amount of the charge built up in the toner does not become excessive where the regulating member having the coating film formed thereon is employed, the amount of toner deposited on the surface of the toner carrier after having been regulated by the regulating member will not increase abnormally and, therefore, any possible scattering of toner particles externally around the image and an abnormal fogging of the entire image can be substantially eliminated.

Also, with the passage of time during which the developing device is repeatedly used for the formation of images, the coating film formed on that portion of the regulating member which is held in contact with the toner carrier abrades progressively, baring that portion of the regulating member so that the toner can be subsequently triboelectrically charged by the regulating member. Accordingly, even though with the passage of time of use of the developing device the toner particles of relatively small particle size are consumed, followed by the supply of the toner particles of relatively large particle size for the image development, no insufficient charging of the toner will occur and, therefore, the problems associated respectively with the fogging of the image and the fall of toner particles from the surface of the toner carrier can be advantageously suppressed.

When in accordance with the present invention the coating film of material having the same polarity in triboelectric series as that of the toner used is formed on that portion of the regulating member cooperable with the toner carrier to triboelectrically charge the toner particles, examples of the material include, although not exclusively limited thereto, metal salt of azo dye, chromium complex dye such as, for example, salicylic acid and naphthoic acid, lead complex dye and ferrous complex dye where the toner to be used in association with the regulating member is of a kind adapted to be charged to a negative polarity (which toner is hereinafter referred to as a "negative chargeable toner"), or nigrosine dye, azine dye, basic dye and quaternary ammonium salt where such toner is of a type adapted to be charged to a positive polarity (which toner is hereinafter referred to as a "positive chargeable toner").

Where the negative chargeable toner is employed, examples of the chromium complex dye utilizable as material for the coating film in the regulating member are commercially available and sold under numerous tradenames, for example, "BONTRON S-34", "BONTRON S-31" and "VALIFAST BLACK 3820", all of Orient Kagaku Kogyo K.K., and "SPIRON BLACK TRH" of Hodogaya Kagaku K.K.

As a means for forming the coating film on that portion of the regulating member, a coating technique may be employed in which the material for the coating film is employed in the form of a fluid paint ready for painting. The fluid paint referred to above may, or may not, be added with a small quantity of binding resin added, ready for painting. It is, however, to be noted that, of the materials listed above for the coating film in the regulating member, some would not result in a satisfactory formation of the coating film when used in connection with the painting technique. Therefore, in such case, the use of an electrodeposition technique wherein a counter electrode is employed is recommended for the formation of the coating film in the regulating member as will be discussed in detail later.

The film thickness of the coating film in the regulating member may vary depending on conditions under which the regulating member is held in contact with the toner carrier and/or the type of material for the coating film used. However, if the film thickness of the coating film is too small, the possibility of the toner being excessively charged at the start of use of the monocomponent developing device can be satisfactorily suppressed and, on the other hand, if the film thickness thereof is too great, the coating film will not be satisfactorily abraded and, as the supply of the toner particles of relatively large particle size supersedes the supply of the toner particles of relatively small particle size with the passage of time of use of the developing device as hereinbefore discussed, the toner will not be satisfactorily charged to such an extent that an image having background stains will result in. Accordingly, in the practice of the present invention, the film thickness of the coating film in the regulating member is selected to be within the range of 0.2 to 3 $\mu$m, preferably 0.2 to 1 $\mu$m.

The coating film on that portion of the regulating member which is brought into contact with the toner carrier is effective in that, because of the presence of the coating film between the toner and the regulating member, the force of the regulating member to attract toner particles can be weakened while a force of repellent is developed between the toner and the coating film having the same polarity of charge as that of the toner, thereby suppressing the adherence of toner particles to the regulating member at a location adjacent that portion of the regulating member where the coating film is formed. Therefore, even though the monocomponent developing device embodying the present invention is operated for a substantially prolonged period of time, no toner will be deposited on the regulating member and, therefore, an undulating thickness of the toner layer formed on the toner carrier can be effectively eliminated. Hence, the possibility of the image varying in density and/or having white-lined noises can also be suppressed effectively.

Hereinafter, the preferred embodiment of the present invention will be described with reference to the accompanying drawings.

Referring first to FIG. 1 showing a schematic side sectional view of an electrophotographic copying machine utilizing the monocomponent developing device according to the present invention, the copying machine comprises an image forming unit U generally disposed at a central region within a machine housing and including a photoreceptor drum 4 which serves as an electrostatic latent image carrier. This photoreceptor drum 4 is supported for rotation in one direction shown by the arrow A and can, during each complete rotation thereof, move past a plurality of processing stations defined in the vicinity of an outer peripheral surface thereof. These processing stations includes a charging station at which an electrostatic charger 5 is disposed for providing an electrostatic potential to the photoreceptor drum 4; a developing station at which a toner carrier 13 is disposed for developing an electrostatic latent image, formed on the photoreceptor drum 4, into a visible powder image; a transfer station at which a transfer charger 7 is disposed for transferring the visible powder image on the photoreceptor drum 4 onto a recording sheet supplied from a sheet supply cassette 19; a separating station at which a separating pawl 200 is disposed for separating the recording sheet from the photoreceptor drum 4 after the transfer of the visible powder image from the photoreceptor drum 4 onto the recording sheet; and a cleaning station at which a cleaning blade 8 is disposed for removing residue toner remaining on the photoreceptor drum 4 in readiness for the next cycle of copying operation. The image forming unit U is of an unitary structure that can be detachable from the machine housing and can be replaced with a new image forming unit of identical structure in the event that a quantity of toner accommodated within a toner reservoir 11 (FIG. 2) defined therein has been consumed completely or substantially completely.

The copying machine utilizing the replaceable image forming unit U also comprises a glass plate 1 for the support thereon of a document to be copied, and an illuminator lamp 2 for illuminating the document on the glass plate 1 to provide imagewise rays of light which are in turn projected onto the photoreceptor drum 4 to form an electrostatic latent image corresponding to an image on the document. As is well known to those skilled in the art, the electrostatic latent image so formed on the photoreceptor drum 4 is developed by the toner carrier 13 into the visible powder image as the photoreceptor drum 4 moves past the developing station, and the visible powder image is then transferred by the transfer charger 7 onto the recording sheet as the photoreceptor drum 4 subsequently moves past the transfer station. The recording sheet is supplied by a sheet feed roller 9 from the sheet supply cassette 19 accommodating a stack of recording sheets and is transported through a plurality of intermediate roller pairs 100 and 110 towards a pair of juxtaposed timing rollers 120*a* and 120*b* which feed the recording sheet onto the transfer station in synchronism with the arrival of the visible powder image on the photoreceptor drum 4 at the transfer station.

The recording sheet onto which the visible powder image has been transferred at the transfer station is separated by the separating pawl 200 from the photoreceptor drum 4 and is then transported through one or more rollers 130 towards a fixing station at which a fixing roller pair 140 is disposed for permanently fixing the visible powder image on the recording sheet as the latter pass therethrough. The recording sheet having the powder image permanently fixed thereon is ejected onto a sheet receiving tray 18 by means of a discharge roller pair 150. The toner left on the photoreceptor drum 4 after the visible powder image has been transferred onto the recording sheet is removed by the cleaning blade 8 as the photoreceptor drum 4 moves past the cleaning station.

Figure 2:
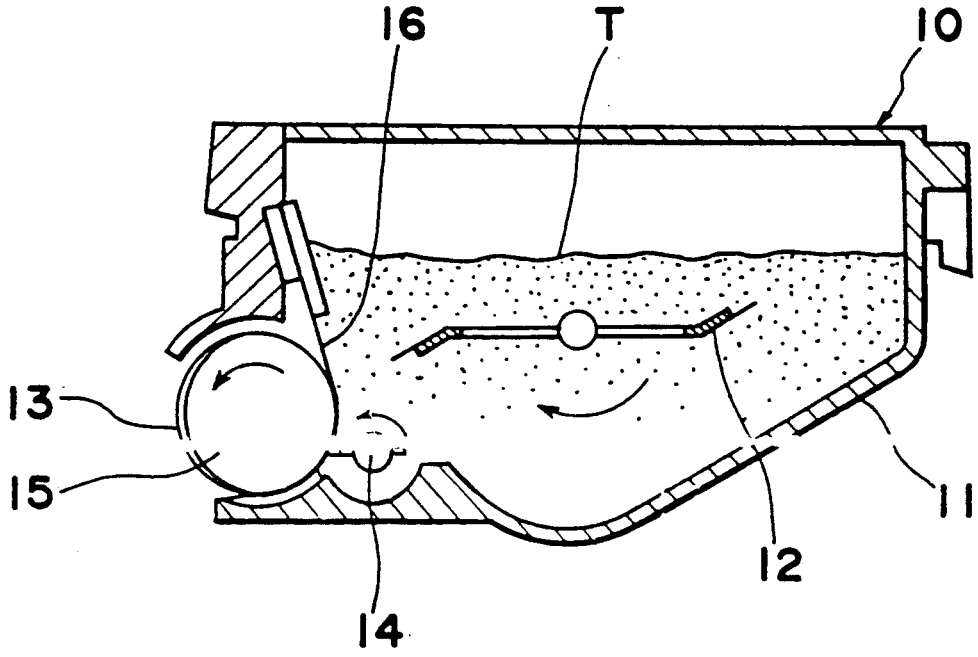
FIG. 2 is a schematic side sectional view, on an enlarged scale, of a monocomponent developing device according to the present invention.

Referring now to FIG. 2, there is shown the details of the monocomponent developing device 10 embodying the present invention. The developing device 10 comprises the toner reservoir 11 accommodating a mass of toner material T and having a first stirring member 12 supported within the toner reservoir 11 for rotation in one direction for stirring toner particles within the toner reservoir 11 and also for positively imparting a motion to the toner particles so as to cause the later to move towards the toner carrier 13.

The toner reservoir 11 also has a second stirring member 14 disposed therein in the vicinity of the toner carrier 13 for rotation in one direction preferably counter to the direction of rotation of the first stirring member 12 so that the toner material T urged towards the toner carrier 13 by the rotation of the first stirring member 12 can be further stirred and, at the same time, forced onto a peripheral surface of the toner carrier 13.

The toner carrier 13 used in the developing device 10 of the above described construction is employed in the form of a thin film member of nickel, 35 μm in thickness and having a surface roughness Rz of 2 μm, which has been formed into a sleeve of an inner diameter greater than a drive roller 15 by the use of an electro-chemical molding method. The toner carrier 13 so formed encloses the drive roller 15 and is held in contact with the drive roller 15 at a portion of the toner carrier 13, confronting the photoreceptor drum 4, by means of a pair of guide members (not shown) which are disposed on respective sides of the toner carrier 13 so as to extend parallel to the longitudinal axis of the toner carrier 13. Thus, it will readily be seen that the rotation of the drive roller 15 can be transmitted to the toner carrier 13 to drive the latter in a direction conforming to the direction of rotation of the drive roller 15 shown by the arrow. That portion of the toner carrier 13 confronting the photoreceptor drum 4 is urged by the drive roller 15 towards the photoreceptor drum 4 so as to softly touch the photoreceptor drum 13.

Figure 3A:
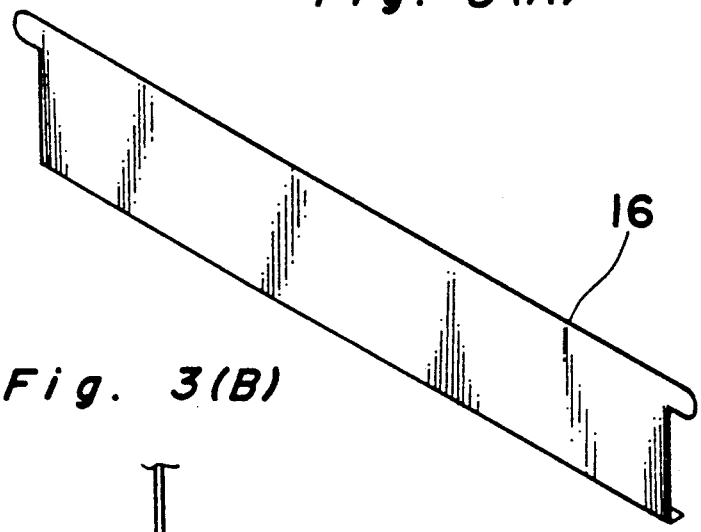
FIG. 3(A) is a perspective view of a regulating member used in the monocomponent developing device.
Figure 3B:
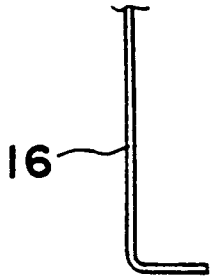
FIG. 3(B) is a cross-sectional view, on an enlarged scale, of the regulating member shown in FIG. 3(A)
Figure 5:
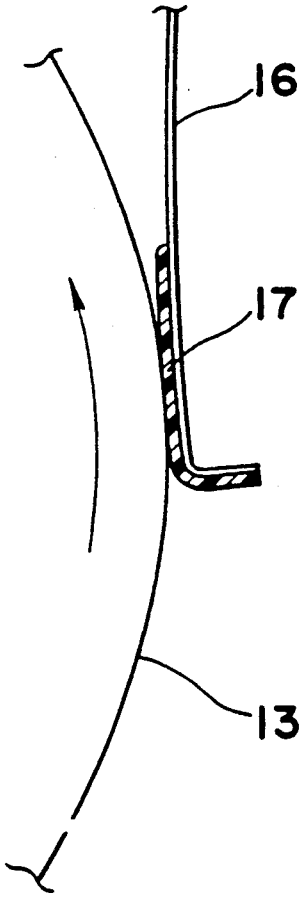
FIG. 5 is an explanatory diagram showing the contact between the regulating member and a developing sleeve.

The regulating member is generally identified by 16 and is operable to triboelectrically charge the toner material supplied onto an outer surface of the toner carrier 13 and also to regulate the amount of toner particles deposited on the outer surface of the toner carrier 13. As best shown in FIGS. 3(A) and 3(B), the regulating member 16 is of a generally rectangular shape having an upper edge portion and a lower edge portion bent to protrude in a direction opposite to the toner carrier 13. This regulating member 16 is fixedly supported within the toner reservoir 11 with the upper edge portion rigidly secured to a side wall of the toner reservoir 11 adjacent the toner carrier 13. In this position, a generally intermediate portion of the regulating member flush with the upper edge portion thereof and a slight distance above the bent line as viewed in FIG. 5 is resiliently held in sliding contact with the toner carrier 13.

Figure 4A:
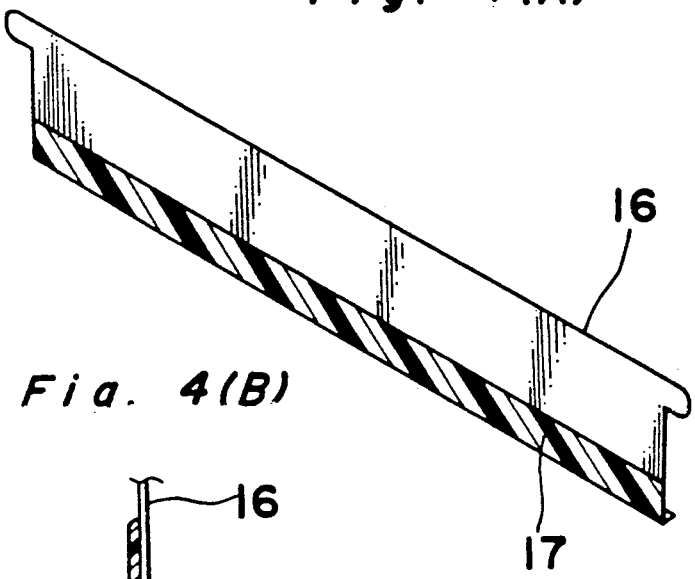
FIGS. 4(A) and 4(B) are views similar to FIGS. 3(A) and 3(B), respectively, showing a coating film formed on the regulating member.
Figure 4B:
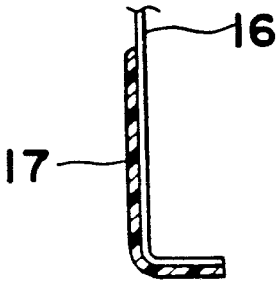

In accordance with the present invention, as best shown in FIGS. 4(A) and 4(B), that portion of the regulating member 16 which is generally held in sliding contact with the toner carrier 13, including areas of the regulating member 16 in the vicinity of that portion, is formed with an abradable coating film 17 capable of being triboelectrically charged to the same polarity as that to which the toner material T is triboelectrically charged, that is, having the same polarity in triboelectric series as that of the toner material T. With the regulating member 16 having the coating film 17 formed thereon, the regulating member 16 is in practice held in sliding contact through the coating film 17 with the toner carrier 13 movable in contact with the drive roller 15 so that the toner material T supplied onto the outer surface of the toner carrier 13 can be triboelectrically charged while being regulated as to its amount.

During the continued rotation of the drive roller 15 accompanied by the corresponding rotation of the toner carrier 13, the toner material on the outer surface of the toner carrier 13 which has been triboelectrically charged while the quantity thereof has been regulated in the manner as hereinabove described is transported towards the photoreceptor drum 4 and is subsequently supplied onto the photoreceptor drum 4 as the toner carrier 13 rotated in one direction merges with the photoreceptor drum 4 then rotated in the arrow-headed direction counter to the direction of rotation of the toner carrier 13, thereby developing the electrostatic latent image on the photoreceptor drum 4 into the visible powder image. It is to be noted that the contact between the toner carrier 13 and the photoreceptor drum 4 takes place softly and without accompanying any relative friction therebetween.

Figure 6A:
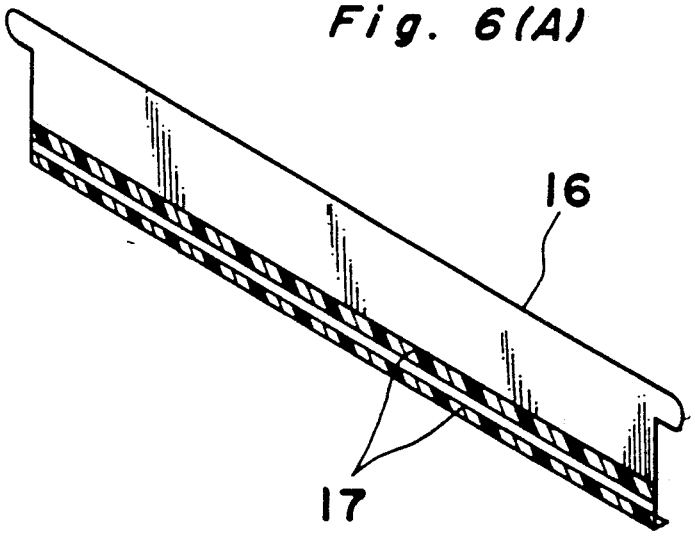
FIGS. 6(A) and 6(B) are views similar to FIGS. 4(A) and 4(B), respectively, showing the coating film partially abraded.
Figure 6B:
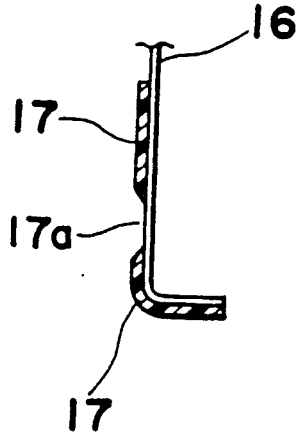

After a number of cycles of copying operation to provide a required number of copies, the coating film 17 formed in the regulating member 16 is abraded in contact with the toner carrier 13 as shown in FIGS. 6(A) and 6(B). Since in practice the contact between the coating film 17 and the toner carrier 13 takes place generally in the form of a line contact, a portion of the coating film 17 intermediate of the width thereof is abraded as indicated by 17*a* with a skin of a corresponding portion of the regulating member 17 consequently exposed. After the coating film 17 has been abraded in the manner as hereinabove described and as shown in FIGS. 6(A) and 6(B), the toner material T supplied onto the outer surface of the toner carrier 13 can be triboelectrically charged by that corresponding portion of the regulating member 16 which has been exposed as a result of the wear of that portion of the coating film 17.

Hereinafter, the present invention will be demonstrated by way of illustrative examples wherein. the monocomponent developing device 10 of the above described construction is employed in combination with the negative chargeable toner material T and wherein the regulating member 16 is formed with the coating film 17 having the same polarity in triboelectric series as that of the toner material T, but made of different material. Some comparisons are also enumerated to show the superiority and effectiveness of the present invention. However, it is to be noted that, in each of the illustrative examples and the comparisons, the negative chargeable toner material T of identical composition was employed, which was prepared by mixing 100 parts by weight of bisphenol A polyester resin (AV: 19, OHV: 23, Tg: 65° C., Softening Point: 123° C.), 5 parts by weight of commercially available carbon black, "MA #8", manufactured and sold by Mitsubishi Kasei Kogyo K.K., 3 parts by weight of "BONTRON S-34" manufactured and sold by Orient Kagaku K.K. and 2.5 parts by weight of "VISCOL TS-200" manufactured and sold by Sanyo Kasei Kogyo K.K., kneading the mixture, pulverizing the mixture, and finally classifying the pulverized mixture so that the resultant toner particles had an average particle size of 10 μm while 80 wt % of the resultant toner particles had a particle size within the range of 7 to 13 μm. The toner particles so obtained were added with 0.75 wt % of a fluidization assisting agent, which was employed in the form of commercially available hydrophobic silica, "TARANOX 500" manufactured and sold by Talco Co., Ltd., and was then mixed and stirred for 1 minute by the use of a homogenizer driven at a rate of 2,000 rpm.

It is to be noted that, for the purpose of clarity, the negative chargeable toner material of the composition described above and used in each of the following examples and comparisons is hereinafter referred to as the specific toner material.

EXAMPLE 1

The regulating member 16 used in this example was in the form of a generally rectangular stainless steel plate prepared from SUS301 steel.

With the use of commercially available chromium complex dye, "S-34" manufactured and sold by Orient Kagaku K.K., the coating film 17 having the same polarity in triboelectric series as that of the toner material T was formed on that portion of the regulating member 16, which is held in contact with the toner carrier 13 and which includes those areas of the regulating member 16 adjacent such portion thereof. In forming the coating film 17, 2 gram. of the chromium complex dye was dissolved into 198 gram of methanol to provide a fluid paint 17*b* comprising 1 wt % chromium complex solution.

Figure 7:
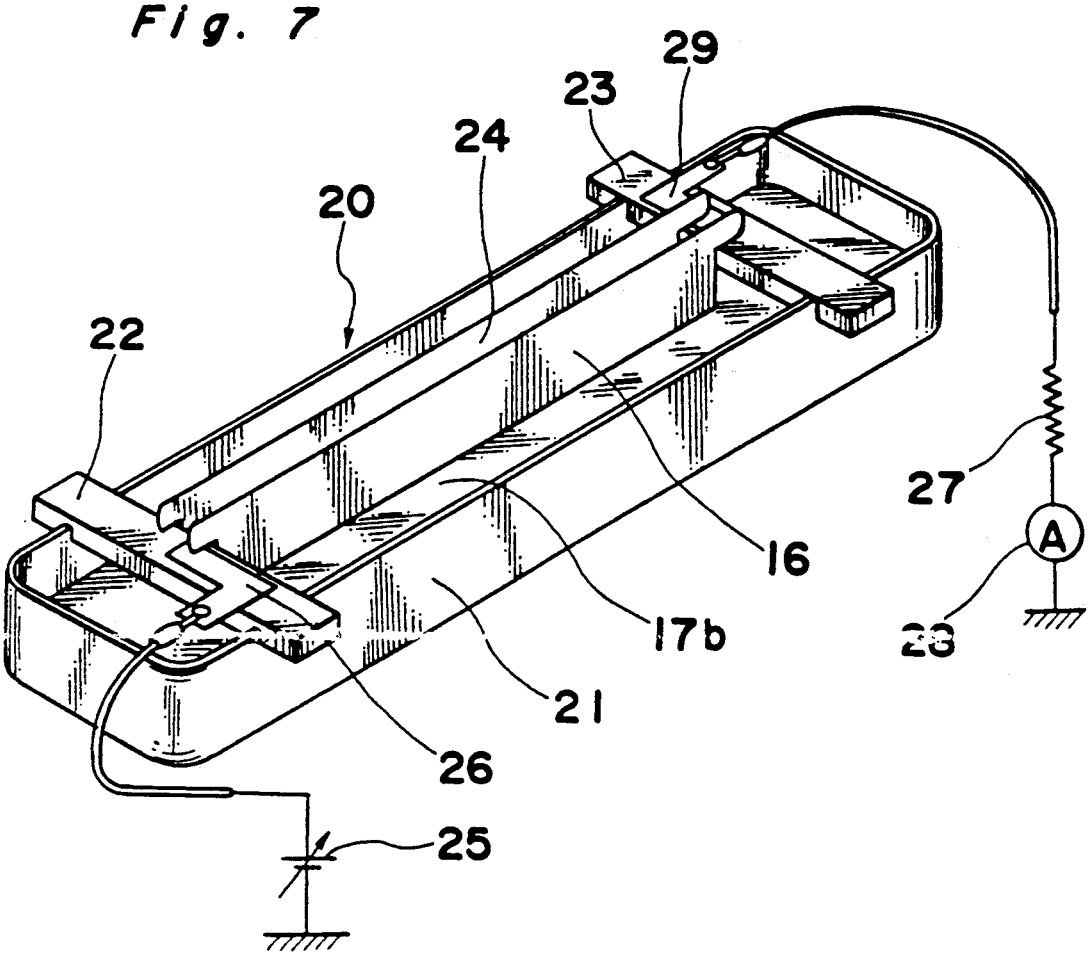
FIG. 7 is a schematic perspective view showing a method of forming the coating film on the regulating member.

When the fluid paint 17*b* was coated on that portion of the regulating member 16 to form the coating film 17, a coating apparatus 20 shown in FIG. 7 was used. This coating apparatus 20 comprises a polyethylene container 21 of generally rectangular box-like configuration filled with the fluid paint 17*b*, a pair of cross support members 22 and 23 mounted on the container 21 above the fluid paint 17*b* so as to extend widthwise of the container 21, and a counter electrode 24 similar in shape to the shape of the regulating member 16 and made of US301 steel. The counter electrode 24 was mounted on the cross support members 22 and 23 so as to extend lengthwise of the container 21 with its lower edge portion immersed into the fluid paint 17*b*.

The regulating member 16 was also mounted on the cross support members 22 and 23 so as to extend parallel to and in face-to-face relationship with the counter electrode 24. With the regulating member 16 while a lower edge portion of the regulating member 16 including the bent edge was immersed into the fluid paint 17*b* in a depth of about 6 mm. The regulating member 16 so supported was spaced a distance of about 6 mm. from the counter electrode 24.

With the regulating member 16 and the counter electrode 24 so supported above the fluid paint 17*b*, one end of the regulating member 16 was electrically connected with a variable direct current power source 25 through a contact electrode 26 fixedly mounted on the cross support member 22, while one end of the counter electrode 24 was connected to the earth through a contact electrode 29, fixedly mounted on the cross support member 23, by way of a 300 KΩ resistor 27 and an ammeter 28.

A voltage of about 600 volts was applied from the variable direct current power source 25 to the regulating member 16 for 2 minutes so that the ammeter 28 indicated a current reading of 2 mA, thereby to electrodeposit the chromium complex dye on that portion of the regulating member 16. The regulating member 16 having the chromium complex dye deposited on that portion thereof was removed from the container 21 and was then dried with the use of a dryer thereby to complete the formation of the coating film 17 of chromium complex dye having a film thickness of 0.3 μm and a hardness equivalent to a 6 H pencil hardness as measured according to the hardness test stipulated in JIS (Japanese Industrial Standards) K5400.

Subsequent to the preparation of the regulating member 16, the regulating member 16 having the coating film 17 was installed in the developing device 10 of the construction shown in and described with reference to FIG. 2 so that that portion of the regulating member 16 where the coating film 17 was formed could be held into contact with the outer surface of the toner carrier 13 under a pressure of about 3 g/mm$^2$ and so that the specific toner material T supplied onto the outer surface of the toner carrier 13 could triboelectrically charged between the regulating member 16 and the toner carrier 13 and, at the same time, the amount of the specific toner material T on the outer surface of the toner carrier 13 could be regulated by the regulating member 16.

The developing device 10 was then installed in an electrophotograhic printer operable at a system speed of 35 mm/sec and the specific toner material T was supplied from the toner carrier 13 onto an organic photoreceptor of laminated type, 30 mm in diameter, for a semiconductor laser, to form an image.

When the developing device 10 in this Example was operated under a 15% relative humidity for the image formation, the amount of charge built up on the specific toner material T which had been triboelectrically charged between the regulating member 16 and the toner carrier 13 was found within the range of −35 to −40 μC/g and the amount of the specific toner material T carried on the outer surface of the toner carrier 13 and regulated by the regulating member 16 was found about 0.5 mg/cm$^2$.

The image so formed was found to be of high quality free from an abnormal fogging, background stains and background fogging.

When the developing device 10 was continously used, and before the toner carrier 13 underwent 10 to 15 complete rotations, a portion 17*a* of the coating film 17 in the regulating member 16 which was held in sliding contact with the toner carrier 13 and which was about 200 μm in width was abraded uniformly over the entire length of the regulating member 16 with a skin of a corresponding portion of the regulating member 17 consequently exposed.

Even when the developing device 10 was operated in an environment of normal temperature of 20° C. and normal relative humidity of 45% and even when it was operated in an environment of high temperature of 35° C. and high relative humidity of 85%, images of high quality free from the background stains and the background fogging could be obtained. This means that the use of the regulating member having the coating film formed therein according to the present invention was effective to eventually provide the high quality images.

Also, when the image wherein the black/white ratio attained 5% was formed in 5,000 sheets, not only did the specific toner material T not stick to that portion of the regulating member 16 which contacted the toner carrier 13, but also the resultant image showed no variation in density with no white-lined noises appearing therein. Thus, the use of the regulating member designed according to the present invention was found effective to render the developing device to operate satisfactorily to provide the high quality images for a prolonged period of time.

COMPARISON 1

Except that no coating film was formed on that portion of the regulating member, the developing device substantially similar to that used in Example 1 was used.

When the developing device in this Comparison was operated under a 15% relative humidity for the image formation, the amount of charge built up on the specific toner material T which had been triboelectrically charged between the regulating member 16 and the toner carrier 13 was found within the range of −35 to −50 μC/g and the amount of the specific toner material T carried on the outer surface of the toner carrier 13 and regulated by the regulating member 16 was found about 1.8 to 2.2 mg/cm$^2$ which was found to be greater than that under Example 1.

When the images are formed under this high humidity environment, second and subsequent copies have shown that the reproduced images were entirely stained with black dots, showing the presence of the abnormal fogging.

When the developing device 10 was continuously used for a prolonged period of time, sticking of the specific toner material T to that portion of the regulating member 16 which was brought into contact with the toner carrier 13 was observed and, at the time 3,000 copies of the images was made, the reproduced images have shown the presence of a variation in density whereas, at the time 4,000 copies of the images was made, the reproduced images have shown the presence of white-lined noises.

EXPERIMENTS 1 to 11

In each of those experiments, during the formation of the coating film 17 on that portion of the regulating member 16 made of a stainless steel plate of SUS301 steel, the voltage applied from the variable direct current power source 25 to the regulating member 16 was adjusted to one of such different values as shown in Table 1 so that the ammeter 28 could indicate a current reading of a corresponding one of different values as shown in Table 1. The length of time during which the voltage was applied from the power source 25 to the regulating member 16 being processed was also changed to one of different values as shown in Table. In other words, in each of those experiments, the conditions under which the coating film 17 was formed were changed as shown in Table 1.

TABLE 1

| Exp. # | Current (mA) | Volt Applied Time (min) | Film Thickness (μm) |
|---|---|---|---|
| 1 | 3 | 2 | 0.35 |
| 2 | 1.68 | 2 | 0.25 |
| 3 | 1.35 | 2 | 0.2 |
| 4 | 0.69 | 2 | 0.085 |
| 5 | 2 | 20 | 3 |
| 6 | 2 | 15 | 2 |
| 7 | 2 | 10 | 1.6 |
| 8 | 2 | 5 | 0.7 |
| 9 | 2 | 3 | 0.4 |
| 10 | 2 | 2 | 0.3 |
| 11 | 2 | 1 | 0.13 |

Each of the regulating members 16 having the respective coating films 17 formed on that portion thereof was installed in the developing device 10 in a manner similar to that under the foregoing example for the image formation to evaluate the quality of the reproduced images and also to evaluate the wear performance of the respective coating film 17. Results of evaluation are tabulated in Table 2 in which the absence and the partial presence of the abnormal fogging in the images are respectively indicated by ○ and Δ; the substantial absence and the slight presence of the background fogging in the images are respectively indicated by ○ and Δ; and the wear performance is shown in terms of the number of rotations of the toner carrier which was effected until the respective coating film 17 was abraded at 17*a*.

TABLE 2

| Exp. # | Abnormal Fogging | Background Fogging | Wear Performance |
|---|---|---|---|
| 1 | ○ | ○ | 20 |
| 2 | ○ | ○ | 15 |
| 3 | ○ | ○ | 15 |
| 4 | Δ | ○ | 10 |
| 5 | ○ | Δ | 800 |
| 6 | ○ | Δ | 600 |
| 7 | ○ | Δ | 100 |
| 8 | ○ | ○ | 40 |
| 9 | ○ | ○ | 20 |
| 10 | ○ | ○ | 15 |
| 11 | Δ | ○ | 10 |

The results have shown that, where the film thickness of the coating film 17 is smaller than 0.2 μm, the coating film 17 is effective to avoid the appearance of the abnormal fogging, but cannot completely eliminate the appearance of the abnormal fogging and that, where the film thickness of the coating film 17 is greater than 3 μm, the coating film 17 is susceptible to separation from the corresponding regulating member 16 when subjected to a slight shock because of the cracking having occurred in the coating film 17 during the drying process.

In view of the foregoing, it has been found that, when the coating film 17 is to be formed on that portion of the regulating member 16, the film thickness thereof is preferred to be within the range of 0.2 to 3 μm.

Also, where the film thickness of the coating film 17 is greater than 1.5 μm, not only is the coating film 17 so low in strength as to be susceptible to damage while requiring a relatively long time to wear, but also the background fogging tends to occur in the reproduced images. Therefore, the coating film 17 is more preferred to have a film thickness not greater than 1 μm.

EXAMPLE 2

In order for the regulating member 16 to have formed on that portion thereof the coating film 17 having the same polarity in triboelectric series as that of the specific toner material T, the fluid paint of a composition similar to that under Example 1, except that the chromium complex dye used in Example 1 was replaced by commercially available "SPIRON BLACK TRH" manufactured and sold by Hodogaya Kagaku K.K. was prepared in a manner similar to that in Example 1 and was applied to the regulating member 16 to eventually form the coating film 17 of 0.35 μm in film thickness.

As is the case with Example 1, the regulating member 16 having the coating film 17 formed therein was installed in the developing device 10 of the construction shown in and described with reference to FIG. 2, which device was in turn used for the image formation.

When the developing device 10 in this Example was operated under a 15% relative humidity for the image formation, the amount of charge built up on the specific toner material T which had been triboelectrically charged between the regulating member 16 and the toner carrier 13 was found to be −40 μC/g and the amount of the specific toner material T carried on the outer surface of the toner carrier 13 and regulated by the regulating member 16 was found about 0.45 mg/cm$^2$.

The image so formed was found to be of high quality free from an abnormal fogging, background stains and background fogging, as is the case with that in Example 1.

When the developing device 10 was continuously used, and before the toner carrier 13 underwent 10 to 15 complete rotations, a portion 17*a* of the coating film 17 in the regulating member 16 which was held in sliding contact with the toner carrier 13 and which was about 200 μm in width was abraded uniformly over the entire length of the regulating member 16 with a skin of a corresponding portion of the regulating member 17 consequently exposed.

Even when the developing device 10 was operated in an environment of normal temperature of 20° C. and normal relative humidity of 45% and even when it was operated in an environment of high temperature of 35° C. and high relative humidity of 85%, images of high quality free from the background stains and the background fogging could be obtained as is the case with that in Example 1. This means that the use of the regulating member having the coating film formed therein according to the present invention was effective to eventually provide the high quality images.

Also, when the image wherein the black/white ratio attained 5% was formed in 5,000 sheets, not only did the specific toner material T not stick to that portion of the regulating member 16 which contacted the toner carrier 13, but also the resultant image showed no variation in density with no white-lined noises appearing therein. Thus, the use of the regulating member designed according to the present invention was found effective to render the developing device to operate satisfactorily to provide the high quality images for a prolonged period of time.

EXAMPLE 3

In this example, a mixture of resin with material having the same polarity in triboelectric series as that of the specific toner material was used as material for the coating film 17 formed on that portion of the regulating member 16. When the coating film 17 is made of the mixture of the resin with the material having the same polarity in triboelectric series as that of the specific toner material, the abrasion of the coating film can be retarded.

Examples of the resin to be mixed with the material for the coating film may include, for example, ketonic resins and resins for a paint fixing agent.

As for the method of forming the coating film with the use of the mixture of the resin with the material having the same polarity in triboelectric series as that of the specific toner material, a painting technique may be employed in which the mixture is employed in the form of a fluid paint and is painted to the regulating member.

Hereinafter, Example 3 will be described.

In this example, when the abradable coating film 17 made of material having the same polarity in triboelectric series as that of the specific toner material was to be formed on that portion of the regulating member 16, an oil-based felt-tip pen (commercially sold under a tradename, "MAKKI ZEBRA") containing chromium complex dye, "VALIFAST BLACK 3820" manufactured and sold by Orient Kagaku K.K. and acetone formaldehyde resin which was selected from a group of ketonic resins was used.

The regulating member 16 used in this example was in the form of a generally rectangular stainless steel plate prepared from SUS301 steel.

During the formation of the coating film 17, the chromium complex dye was applied by the oil-based felt-tip pen to a surface of that portion of the regulating member 16 confronting the toner carrier 13 to form the coating film 17.

For testing purpose, the number of application of the chromium complex dye with the use of the oil-based felt-tip pen to each of the regulating members 16 of identical construction was varied to provide the respective coating films 17 of 3.09, 1.05, 0.51, 0.26 and 0.15 μm in film thickness.

For each test conducted, the respective regulating member 16 having the coating film 17 of different film was installed in the developing device 10 of the construction shown in and described with reference to FIG. 2, which device was in turn used for the image formation for the purpose of evaluating the quality of the reproduced images and also to evaluating the wear performance of the respective coating film 17. Results of evaluation are tabulated in Table 3.

TABLE 3

| Film Thickness (μm) | Abnormal Fogging | Background Fogging | Wear Performance |
|---|---|---|---|
| 3.09 | ○ | Δ | 4,000 |
| 1.05 | ○ | ○ | 2,000 |
| 0.51 | ○ | ○ | 1,300 |
| 0.26 | ○ | ○ | 900 |

TABLE 3-continued

| Film Thickness (μm) | Abnormal Fogging | Background Fogging | Wear Performance |
|---|---|---|---|
| 0.15 | Δ | ○ | 200 |

In Table 3 above, the absence and the partial presence of the abnormal fogging in the images are respectively indicated by ○ and Δ; the substantial absence and the slight presence of the background fogging in the images are respectively indicated by ○ and Δ; and the wear performance is shown in terms of the number of rotations of the toner carrier which was effected until the respective coating film 17 was abraded at 17*a*.

The results have shown that, where the film thickness of the coating film 17 is relatively small, the coating film 17 is effective to avoid the appearance of the abnormal fogging, but cannot completely eliminate the appearance of the abnormal fogging and that, where the film thickness of the coating film 17 is relatively great, not only is a relative long time required to allow the coating film 17 to be abraded, but also a slight background fogging is found at the initial stage. In view of this, it has been found that, when the coating film 17 is to be formed on that portion of the regulating member 16, the film thickness thereof is preferred to be within the range of 0.2 to 1 μm.

EXAMPLE 4

Even in this example, a mixture of resin with material having the same polarity in triboelectric series as that of the specific toner material was used as material for the coating film 17 formed on that portion of the regulating member 16.

The amount of the resin contained in the coating film is within the range of 20 to 60 wt %, preferably 30 to 50 wt %. If the amount of the resin is smaller than 20 wt %, the resultant coating film is quick to disappear after the formation of several images and no initial phenomenon in which the background fogging and the background stains resulting from the toner scattering can be sufficiently suppressed. On the other hand, if the amount of the resin used is greater than 60 wt %, the resultant coating film is slow to disappear and, therefore, the specific toner material cannot be sufficiently charged resulting in a poor image reproduction.

Hereinafter, Example 4 will be described.

The regulating member 16 used in this example was in the form of a generally rectangular stainless steel plate prepared from SUS301 steel. As an organic dye effective to control the chargeability of the specific toner material, a solvent black 27 (a commercially available dye, "VALIFAST BLACK 3820" manufactured and sold by Orient Kagaku K.K.) was used and, as a resin to be mixed therewith, acetone formaldehyde resin selected from a group of ketonic resins was used. A coating solution prepared by dissolving a mixture of 10 gram of the dye and 5 gram of the resin with the use of 50 gram of a solvent which was a mixture of β-oxyethyl methyl ether with a commercially available alcoholic mixed solvent, "SOLMIX" manufactured and sold by Nippon Kasei K.K. The resultant coating solution was subsequently injected, in a quantity of 5 gram, into a barren of an oil-based felt-tip pen. Then, in a manner similar to an ordinary felt-tip pen being used for delineating, the coating to form the coating film 17 was carried out by delineating the oil-based felt-tip pen in one stroke at a speed of 5.8 cm/min with the application of a pressure of 250 gram. The resultant coating film 17 was about 0.5 μm in film thickness.

The developing device 10 in which the regulating member 16 having the coating film 17 so formed therein in the manner described above had been disposed was then installed in an electrophotographic printer to copy an image on a white paper, the amount of charge built up on a thin layer of the specific toner material T on the toner carrier 13, which had been triboelectrically charged between the regulating member 16 and the toner carrier 13, was found within the range of −35 to −40 μC/g and the amount of the specific toner material T regulated by the regulating member 16 was found about 0.6 to 0.7 mg/cm$^2$. The image so formed was found to be of high quality free from an abnormal fogging, background stains and background fogging.

When the developing device 10 was continuously used, and before the toner carrier 13 underwent a number of complete rotations required to finish about 60 copies, a portion 17*a* of the coating film 17 in the regulating member 16 which was held in sliding contact with the toner carrier 13 and which was about 400 μm in width was completely abraded uniformly over the entire length of the regulating member 16 with a skin of a corresponding portion of the regulating member 17 consequently exposed. The initial effect of suppressing the abnormal fogging could be appreciated until the portion 17*a* of the coating film 17 was completely abraded away and any phenomenon such as the abnormal fogging was no longer found in the images which were subsequently copied.

Even when the developing device 10 was operated in an environment of normal temperature of 20° C. and normal relative humidity of 45% and even when it was operated in an environment of high temperature of 35° C. and high relative humidity of 85%, images of high quality free from the background stains and the background fogging could be obtained. This means that the use of the regulating member having the coating film formed therein according to the present invention was effective to eventually provide the high quality images.

Also, when the image wherein the black/white ratio attained 5% was formed in 5,000 sheets, not only did the specific toner material T not stick to that portion of the regulating member 16 which contacted the toner carrier 13, but also the resultant image showed no variation in density with no white-lined noises appearing therein. Thus, the use of the regulating member designed according to the present invention was found effective to render the developing device to operate satisfactorily to provide the high quality images for a prolonged period of time.

Where the content of the resin in the coating film 17 within the range of 20 to 60 wt %, preferably 30 to 50 wt %, has been found resulting in effects similar to those obtained in the foregoing Examples. Specifically, not only could the abnormal fogging be suppressed, but also no side effects such as the background fogging, resulting from a reduction in chargeability of the specific toner material, and the background stains resulting from the toner scattering around the image could be observed before and after the coating film 17 was abraded.

In Table 4, results of experiments are tabulated, in which the coating film of 0.5 μm in film thickness was thoroughly employed.

TABLE 4

| Exp. # | Content Dye (wt %) | Content Resin (wt %) | Suppression of Abnormal Fogging | Toner Material Initially charged to: (μC/g) | Toner Material Regulated to: (mg/cm²) | Wear Performance |
|---|---|---|---|---|---|---|
| 1 | 80 | 20 | ○~Δ | −40~−45 | 1.0 | ab. 30 |
| 2 | 67 | 33 | ○ | −35~−40 | 0.8 | ab. 60 |
| 3 | 50 | 50 | ○ | −35~−40 | 0.6 | ab. 80 |
| 4 | 40 | 60 | ○ | −35~−35 | 0.5 | ab. 100 |

It is to be noted that, in Table 4 above, the wear performance of the coating film 17 was measured in terms of the approximate number of copies made until the abrasion of the coating film 17 took place and that, in all Experiments 1 to 4, neither the background fogging nor the background stains were observed when and after 100 copies has been made and that the evaluation of the suppression of abnormal fogging in Table 4 is similar to that in any one of the foregoing Experiments.

Again, it is to be noted that the reason that the amount of charge to which the toner material was initially charged did not show a considerable variation in those Experiments is because the coating film 17 has not yet been completely abraded, partially remaining on the regulating member 16 and that the presence of the background fogging and the background stains in the reproduced images which appeared to have been brought about by a reduction in chargeability of the toner material after 100 copies had been made appears to have resulted from the incomplete abrasion of that portion of the coating film 17 which was actually held in contact with the toner carrier 13.

COMPARISON 2

5 gram of organic dye, solvent black 27, was added with 10 gram of acetone formaldehyde resin to provide a dye-resin mixture containing the dye and the resin in a mixing ratio of 1:2 (33 wt %:67 wt %). This dye-resin mixture was then added with 50 gram of the solvent of the same composition as that in Example 4 to provide the coating solution. When this coating solution was applied to that portion of the regulating member 16 in a manner similar to that in Example 4, the coating film of about 0.6 to about 1.0 μm in film thickness was obtained.

When the image formation was carried out in a manner similar to that in Example 4 with the use of the regulating member formed with the coating film, the occurrence of the abnormal fogging could be suppressed, but the coating film did not abrade even when 200 or more copies were made and, after 100 copies had been made at which the chargeability of the specific toner material T had begun to decrease, the background fogging and the background stains were observed. The amount of charge to which the toner layer of the specific toner material T formed on the outer surface of the toner carrier 13 at this time was found to be within the range of −20 to −30 μC/g and the same toner layer was regulated to 0.4 to 0.5 mg/cm². The occurrence of the background fogging continued up to about 250 copies at which the coating film appeared to have disappeared completely.

EXAMPLE 5

Using 10 gram of "HYLUCK 110H" (a commercially available ketonic resin manufactured and sold by Hitachi Kaseihin K.K.) in place of the acetone formaldehyde resin, relative to 10 gram of an organic dye, solvent black 27, and also using as a solvent 60 gram of propylene glycol monomethyl ether, a coating solution was prepared. When this coating solution was applied to that portion of the regulating member 16, which was made of SUS301 steel, in a manner similar to that in Example 4, the coating film of about 0.4 to about 0.7 μm in film thickness was obtained.

When the image formation was carried out in a manner similar to that in Example 4 with the use of the regulating member formed with the coating film, no abnormal fogging was observed. The coating film did not abrade before about 50 copies were made and, therefore, up until about 50 copies were made, the occurrence of the abnormal fogging could be suppressed and no abnormal fogging was observed even thereafter.

Since the coating film disappear in abrasive contact with the toner carrier when and after the image formation had been continued to provide 50 copies, neither the background fogging nor the background stains resulting from a reduction in chargeability of the specific toner material were observed.

The amount of charge to which the toner layer of the specific toner material T formed on the outer surface of the toner carrier 13 and the amount of the toner layer regulated by the regulating member showed respective values similar to those in Example 4.

It is to be noted that, even when the resin and the solvent were changed, effects similar to those exhibited under Example 4 could be obtained as far as the amount of the resin contained in the coating film was 20 to 60 wt %.

Example 6

Using 5 gram of acetone formaldehyde resin was mixed with 10 gram of a commercially available organic dye, "VALIFAST VIOLET 3705-T" manufactured and sold by Orient Kagaku K.K., to provide a dye-resin mixture. This dye-resin mixture was then mixed with 90 gram of a solvent consisting of methyl ethyl ketone (MEK) and a slight amount of amine, used as a dissolution assisting agent, thereby to provide a coating solution. When this coating solution was applied to that portion of the regulating member 16, which was made of SUS301 steel, in a manner similar to that in Example 4, the coating film of about 0.4 to about 0.7 μm in film thickness was obtained.

When the image formation was carried out in a manner similar to that in Example 4 with the use of the regulating member formed with the coating film, no abnormal fogging was observed. The coating film did not abrade before about 50 copies were made and, therefore, up until about 60 copies were made, the occurrence of the abnormal fogging could be suppressed and no abnormal fogging was observed even thereafter.

Since the coating film disappear in abrasive contact with the toner carrier when and after the image formation had been continued to provide 60 copies, neither the background fogging nor the background stains resulting from a reduction in chargeability of the specific toner material were observed.

The amount of charge to which the toner layer of the specific toner material T formed on the outer surface of the toner carrier 13 and the amount of the toner layer regulated by the regulating member showed respective values similar to those in Example 4.

Although the present invention has been fully described in connection with the preferred embodiment thereof and also with the various illustrative examples, it is to be noted that various changes and modifications are apparent to those skilled in the art. Such changes and modifications are to be understood as included within the scope of the present invention as defined by the appended claims, unless they depart therefrom.

What is claimed is:

1. A monocomponent developing device comprising.

a developing roller rotatably provided and confronting a rotatable photoreceptor;

a supplying means for supplying a toner onto said developing roller;

a regulating member in contact with the surface of the developing roller for frictionally charging the toner supplied onto the developing roller while regulating the amount of the toner; and a coating film provided on the surface of said regulating member at least in a portion contacting with the developing roller and having the same polarity in triboelectric series as the toner, said coating film being so formed to be abraded away so that the surface of the regulating member exposes after repetition of developing.

2. The device as claimed in claim 1, wherein said coating film restrains the triboelectricity with the regulating member of the toner.

3. The device as claimed in claim 1, wherein said coating film has a thickness of 0.2 to 3 μm.

4. The device as claimed in claim 1, wherein said coating film is formed by an electric deposition method.

5. The device as claimed in claim 1, wherein said coating film is composed of a mixture of material having the same polarity in triboelectric series as the toner and a resin for delaying the abrasion of said material.

6. The device as claimed in claim 1, which is accommodated in a unit integrally with a photoreceptor and a cleaner.

7. A monocomponent developing device comprising.

a developing roller rotatably provided and confronting a rotatable photoreceptor;

a supplying means for supplying a toner onto said developing roller;

a regulating member in contact with the surface of the developing roller for frictionally charging the toner supplied onto the developing roller while regulating the amount of the toner; and a coating film provided on the surface of the regulating member at least in a portion contacting with the developing roller for adjusting the amount of the triboelectricity by the regulating member of the toner during the development.

8. The device as claimed in claim 7, wherein said coating film has the same polarity in triboelectric series as the toner and being so formed to be abraded away so that the surface of the regulating member exposes following repetition of developing.

9. A monocomponent developing device comprising:

a developing roller rotatably provided and confronting a rotatable photoreceptor;

a supplying means for supplying a toner onto said developing roller;

a regulating member in contact with the surface of the developing roller for frictionally charging the toner supplied onto the developing roller while regulating the amount of the toner; and a coating film provided on the surface of the regulating member at least in a portion contacting with the developing roller and being so formed to be abraded away so that the surface of the regulating member exposes after repetition of developing, said coating film composed of a mixture of a material having the same polarity in triboelectric series as the toner and a resin for delaying the abrasion of said material.

10. The device as claimed in claim 9, wherein the weight percent of said resin is 20 to 60 wt %.

11. The device as claimed in claim 9, wherein the resin contained in the coating film is ketonic resin.

12. The device as claimed in claim 9, wherein said coating film has a thickness of 0.2 to 3 μm.

* * * * *